US009947523B2

(12) United States Patent
Brown et al.

(10) Patent No.: US 9,947,523 B2
(45) Date of Patent: Apr. 17, 2018

(54) METHOD OF TRANSMITTING IONS THROUGH AN APERTURE

(71) Applicant: MICROMASS UK LIMITED, Wilmslow (GB)

(72) Inventors: Jeffrey Mark Brown, Hyde (GB); Paul Murray, Manchester (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/348,453

(22) Filed: Nov. 10, 2016

(65) Prior Publication Data

US 2017/0133213 A1 May 11, 2017

(30) Foreign Application Priority Data

Nov. 10, 2015 (GB) ..... 1519830.2

(51) Int. Cl.

| | |
|---|---|
| ***H01J 49/40*** | (2006.01) |
| ***H01J 49/24*** | (2006.01) |
| ***H01J 49/06*** | (2006.01) |
| ***H01J 49/00*** | (2006.01) |
| ***H01J 49/04*** | (2006.01) |
| ***H01J 49/16*** | (2006.01) |

(52) U.S. Cl.

CPC ..... *H01J 49/061* (2013.01); *H01J 49/0027* (2013.01); *H01J 49/0495* (2013.01); *H01J 49/164* (2013.01); *H01J 49/40* (2013.01)

(58) Field of Classification Search

CPC ..... H01J 49/40; H01J 49/0086; H01J 49/067; H01J 49/401; H01J 49/063; H01J 49/066; H01J 49/107; H01J 49/24; H01J 49/403; H01J 49/408; H01J 49/421; H01J 49/427; G01N 27/622; G01N 27/624; G01N 30/466

USPC ..... 250/287, 288, 282, 286, 296, 292, 283, 250/294, 299, 300, 396 R

See application file for complete search history.

(56) References Cited

U.S. PATENT DOCUMENTS

| | | | | |
|---|---|---|---|---|
| 2,709,222 A * | 5/1955 | Lawrence | B01D 59/48 | 250/284 |
| 2,957,985 A * | 10/1960 | Brubaker | H01J 49/282 | 250/287 |
| 3,231,735 A * | 1/1966 | Peters | G01M 3/202 | 250/296 |
| 3,519,942 A * | 7/1970 | Mobley | G21K 1/04 | 250/251 |

(Continued)

FOREIGN PATENT DOCUMENTS

GB 2390935 1/2004

*Primary Examiner* — David A Vanore

(57) ABSTRACT

A mass spectrometer includes: an ion source; an aperture; a flight region arranged between the ion source and aperture for separating ions according to their mass to charge ratio; and ion optics arranged and configured for causing ions to be reflected or deflected while they separate according to mass to charge ratio in the flight region and such that the ions are focussed to a geometrical focal point at the aperture so that the ions are transmitted through the aperture. The multi-reflecting or multi-deflecting ion optics provides a relatively long flight path for the ions, while naturally converging the ion beam to a focus. As this focus is arranged at the aperture, it enables the aperture to be made relatively small while still maintaining high ion transmission efficiency.

18 Claims, 4 Drawing Sheets

(56) References Cited

U.S. PATENT DOCUMENTS 3,553,452 A * 1/1971 Tiernan ..... H01J 49/403 250/287
4,472,631 A * 9/1984 Enke ..... B01D 59/44 250/281
4,578,589 A * 3/1986 Aitken ..... H01J 37/3171 250/281
5,013,923 A * 5/1991 Litherland ..... H01J 49/0086 250/294
5,270,542 A * 12/1993 McMurry ..... H01J 49/0445 250/251
5,962,849 A 10/1999 Saito et al.
6,040,575 A * 3/2000 Whitehouse ..... B82Y 15/00 250/282
6,222,185 B1 * 4/2001 Speakman ..... H01J 49/0481 250/288
6,410,915 B1 * 6/2002 Bateman ..... H01J 49/0431 250/281
6,441,369 B1 * 8/2002 Vestal ..... H01J 49/40 250/281
6,534,764 B1 * 3/2003 Verentchikov ..... H01J 49/40 250/282
6,639,213 B2 * 10/2003 Gillig ..... H01J 49/06 250/281
6,683,299 B2 * 1/2004 Fuhrer ..... H01J 49/004 250/282
6,717,132 B2 4/2004 Franzen
7,164,122 B2 * 1/2007 Fuhrer ..... G01N 27/622 250/282
7,863,557 B2 1/2011 Brown
9,324,553 B2 4/2016 Makarov et al.
2003/0089847 A1 * 5/2003 Guevremont ..... G01N 27/624 250/282
2003/0168590 A1 * 9/2003 Weiss ..... H01J 49/401 250/286
2005/0092918 A1 * 5/2005 Smith ..... G01N 27/622 250/288
2008/0272289 A1 * 11/2008 Vestal ..... H01J 49/025 250/287
2008/0272291 A1 11/2008 Vestal
2008/0272293 A1 11/2008 Vestal
2009/0014647 A1 * 1/2009 Senko ..... H01J 49/004 250/296
2015/0357176 A1 * 12/2015 Sano ..... H01J 49/061 250/287
2017/0133213 A1 * 5/2017 Brown ..... H01J 49/0027

* cited by examiner

METHOD OF TRANSMITTING IONS THROUGH AN APERTURE

CROSS-REFERENCE TO RELATED APPLICATION

This application claims priority from and the benefit of United Kingdom patent application No. 1519830.2 filed on 10 Nov. 2015. The entire contents of this application are incorporated herein by reference.

FIELD OF THE INVENTION

The present invention relates generally to mass spectrometers and in particular to spectrometers in which ions are transmitted through an aperture.

BACKGROUND

Open loop multi-reflection time of flight mass spectrometer are usually composed of repeat focusing cells in which ideal stigmatic focusing in X-, Y- and Z-dimensions is achieved from cell to cell. Cells can either be segments of sectors, quadrupole devices, Einzel lenses or combinations of these devices. Typically, it is a requirement that the angular and lateral magnification for each dimension is as close to unity as possible through each cell, or through integer multiple of cells. If the focusing magnification is not unity, then for each circuit of the ion beam, the beam dimensions would iteratively expand beyond the geometric limits of each focusing device and ions would be lost.

In addition to geometric focusing, it is also a requirement to have a good degree of energy focusing. This is usually achieved by higher energy ions taking an extended flight path through each reflecting device. Although these higher energy ions have a relatively long time of flight through each reflecting device, this is balanced by the relatively shorter time of flight of these ions through the field-free regions.

It is well known that the mass resolving power of a time of flight mass spectrometer can be increased by extending the overall flight path for all of the ions, provided that the stigmatic and energy focusing aberrations are minimised over the complete flight. However, as the ion flight path length is increased the ions become proportionally more susceptible to collisions with residual gas molecules. Such collisions cause scattering of ions and huge losses in ion transmission and instrument resolution. As such, a relatively high vacuum must be maintained in the instrument. It is particularly difficult to include a relatively high pressure gas cell within or downstream of the time of flight instrument without causing an undesirably high collision rate within the ions time of flight path. For example, it is particularly difficult to include a relatively high pressure collisionally induced dissociation (CID) cell within such an instrument for performing MS/MS analysis.

It is desired to provide an improved mass spectrometer and an improved method of mass spectrometry.

SUMMARY

The present invention provides a mass spectrometer or ion mobility spectrometer comprising:

an ion source;

an aperture;

a flight region arranged between said ion source and aperture for separating ions according to their mass to charge ratio; and ion optics arranged and configured for causing ions to be reflected or deflected whilst they separate according to mass to charge ratio in the flight region and such that the ions are focussed to a geometrical focal point at said aperture so that the ions are transmitted through the aperture.

The multi-reflecting or multi-deflecting ion optics provides a relatively long flight path for the ions, whilst naturally converging the ion beam to a focus. As this focus is arranged at the aperture, it enables the aperture to be made relatively small whilst still maintaining high ion transmission efficiency.

GB 2361353 discloses a multi-reflecting time of flight instrument comprising a slotted mask upstream of a detector. However, the ion beam is focussed at the detector, rather than the slotted mask. As such, the slot must be relatively large.

GB 2390935 discloses separating ions in a first time of flight device, fragmenting the ions in a CID cell, and then separating the fragments in a second time of flight device. Although the CID cell has an entrance aperture, GB'935 does not disclose ion optics that reflect or deflect ions, whilst they separate according to mass to charge ratio, such that the ions are focussed to a geometrical focal point at the aperture. GB'935 does not disclose or suggest the use of multi-reflecting or multi-deflecting ion optics so as to naturally converge the ion beam to a focus at the aperture.

According to embodiments of the present invention, the aperture may be a physical aperture through a wall, plate or electrode; or the aperture may be an ion acceptance aperture of a device such as an ion guide, ion trap or ion analyser. The ion acceptance aperture of a device is the area over which ions can be received by the device, and may be defined by electric or magnetic fields of the device rather than a physical structure.

Any one or combination of the following devices may be arranged downstream of said aperture: an ion gate (e.g. a Bradbury-Nielsen ion gate), an ion fragmentation device, an ion reaction device, a CID fragmentation device, an ETD or ECD fragmentation device, a photo-dissociation device, an ion analyser, a mass analyser, an ion mobility separator, an ion deceleration device, an ion guide, an ion trap, or an ion detector.

The spectrometer may further comprise a first vacuum chamber containing the flight region and a second vacuum chamber; wherein the aperture is a differential pumping aperture arranged at the interface between the first and second vacuum chambers.

The spectrometer may further comprise at least one vacuum pump for maintaining said first vacuum region at a lower pressure than said second vacuum region.

The ion optics are arranged and configured so as to cause the ions to arrive at the geometrical focal point at the first differential pumping aperture so that the ions are transmitted through the differential pumping aperture into the second vacuum chamber with high transmission efficiency.

Any one or combination of the following devices may be arranged in the second vacuum chamber: an ion fragmentation or reaction device; a CID fragmentation device; an ETD or ECD fragmentation device; a photo-dissociation device; an ion analyser; a mass analyser; an ion mobility separator; an ion deceleration device; an ion guide; and an ion trap.

The spectrometer is configured to maintain said one or combination of the devices at a higher pressure than the flight region or first vacuum chamber.

The spectrometer may comprise one or more ion gate upstream and/or downstream of the aperture for selectively transmitting ions to and/or from the aperture. The ion transmission properties of the ion gate may vary with time, e.g. such that ions are blocked at one time and transmitted at another time. The one or more ion gate may be used to select the ions that are transmitted into or through the aperture and/or second vacuum chamber. For example, because the ions separate according to mass to charge ratio in said flight region, the ion transmission property of the ion gate may vary with time so as to select the mass to charge ratios of the ions that are transmitted through the aperture and/or second vacuum chamber. The ion gate may be a Bradbury-Nielsen ion gate.

The spectrometer may further comprise a third vacuum chamber downstream of the second vacuum chamber, wherein a second differential pumping aperture is provided at the interface between the second and third vacuum chambers; and optionally wherein said third vacuum chamber comprises an ion analyser.

The ions from the second vacuum chamber (e.g. fragment or product ions) may be analysed in the third vacuum chamber.

The analyser in the third vacuum chamber may be a mass analyser such as a time of flight analyser. Accordingly, ions may be pulsed into, or within, the third vacuum chamber onto a detector that determines the mass to charge ratios of these ions from their flight times.

The third vacuum chamber may be maintained at a lower pressure than the second vacuum chamber by a vacuum pump.

The ion source may comprise a sample target plate and/or a laser source.

If a target plate is used, the target plate may be arranged in the first vacuum chamber.

If a laser source is used, the spectrometer may be configured to direct the laser onto the same side of the target plate that the sample is located on, or on the opposite side, in order to ionise the sample.

At least part of the ion source may be arranged in the first vacuum chamber. For example, the sample target plate and/or laser may be arranged in the first vacuum chamber. The laser source may be positioned outside of the first vacuum chamber and may direct laser light through a window in the first vacuum chamber and onto the sample target plate so as to generate ions inside the first vacuum chamber.

The spectrometer may further comprise a lens for focussing a laser from the laser source onto the target plate in one mode of operation; and/or a lens for directing a homogenous laser beam from the laser source onto the target plate in another mode of operation.

For example, a focal lens may be used to operate the instrument in a microprobe mode; or a homogenous laser beam may be used to operate the instrument in a microscope mode.

The laser may have a diameter of ≤x μm at the target plate, wherein x is selected from the group consisting of: 250; 200; 150; 100; and 50.

The ion optics may be arranged and configured to reflect or deflect the ions a plurality of times as they separate according to their mass to charge ratios in the flight region; and/or the ion optics may be arranged and configured to geometrically focus the ions a plurality of times as they separate according to their mass to charge ratios in the flight region.

The ion optics may be arranged and configured to cause the mean ion path to be reflected or deflected as the ions pass along the flight region; and to cause the ion trajectories to alternate between diverging and converging as the ions pass along the flight region such that the ions converge to the geometrical focal point at said aperture.

The multi-reflecting or multi-deflecting ion optics may be of the form described in U.S. Pat. No. 7,863,557.

The ion optics may comprises a plurality of electric sectors. Said plurality of electric sectors may comprise at least three or more electric sectors. Each of these sectors may cause the ions to switch between diverging and converging, or vice versa.

The ion source may be arranged at the object plane of the ion optics and the aperture may be arranged at the imaging plane of the ion optics.

The spectrometer may further comprise an ion detector; optionally a position sensitive ion detector.

The detector may be arranged in the first vacuum chamber, optionally adjacent to said aperture.

The spectrometer may be configured to determine the mass to charge ratio of an ion from its time of flight through the flight region to the detector. For example, the spectrometer may determine the duration between a time that a laser pulse generates an ion and a time that the ion is detected, and then use this duration to determine the mass to charge ratio of the ion.

The spectrometer may be configured to detect the position at which any given ion strikes the detector and record data related to this position with the ion signal for the detected ion, thereby indicating the position in the ion source from which the ion originated.

The detector may be configured to detect, in one dimension or in two dimensions, the position at which any given ion strikes the detector.

The imaging plane of the ion optics may be located at the detector. For example, the detector may be located in the first vacuum chamber, optionally adjacent to the first differential pumping aperture.

The ion optics may magnify and/or map an image of the ion source to the detector.

The spectrometer may comprise a translator for moving at least part of the ion source relative to the aperture such that: in a first mode when said at least part of the ion source is located at a first position, the ion optics focus the ions from the ion source to the aperture; and in a second mode when said at least part of the ion source is located at a second position, the ion optics focus the ions from the ion source to the detector.

For example, said at least part of the ion source that is moved may be the target plate and/or laser.

The spectrometer may comprise a laser switching device operable such that: in one mode a laser in the laser source is directed at a target plate in the ion source so as to generate ions, and the ion optics focus these ions from the ion source to the aperture; and in another mode a laser in the laser source is directed at the target plate in the ion source so as to generate ions, and the ion optics focus these ions from the ion source to the detector.

The laser in the said one mode may be focussed onto the target plate and the laser in said another mode may project a homogenous beam on the target plate. Alternatively, focussed lasers or homogeneous lasers may be used in both modes.

The spectrometer may comprise an ion deflector or ion guiding device for deflecting or guiding the ions, wherein the deflector or guiding device is operable in one mode such that the ions are transmitted to the aperture, and is operable in another mode such that the ions are not transmitted to the aperture.

The spectrometer may be configured such that in said another mode the ions are transmitted to a detector.

The detector is desirably the previously described detector (e.g. the detector in the first vacuum chamber).

The deflector may be operable such that it does not deflect ions in said one mode and deflects ions in said another mode; or such that it deflects ion trajectories towards and through the aperture in said one mode and does not deflect ions in said another mode; or such that it deflects ions in both modes.

The spectrometer may be configured so as to switch the deflector or guiding device between said one mode and said another mode. In said one mode, precursor ions may be directed through said aperture, fragmented or reacted to produce fragment or product ions, and then the resulting fragment or product ions may be mass analysed. In said another mode, precursor ions may be mass analysed at the detector upstream of the aperture. The spectrometer may be configured to associate precursor ions with their fragment or product ions, e.g. based on their respective detection times. The spectrometer may be configured to repeatedly alternate between the two modes, e.g. in order to perform $MS^e$ analysis.

The spectrometer may comprise a mass selector; wherein, in use, ions separate in the flight region such that ions of different mass to charge ratios arrive at the mass selector at different times; and wherein the mass selector is configured to selectively transmit or deflect one or more first mass to charge ratios or first ranges of mass to charge ratios to the aperture, or a detector, at one or more first times; and to selectively block or deflect one or more second mass to charge ratios or second ranges of mass to charge ratios at one or more second times such that these ions do not reach the aperture, or detector.

A time-varying voltage may be applied to the mass selector in order to achieve these functions.

The detector is desirably the previously described detector, e.g. the detector in the first vacuum chamber, which may be a position sensitive detector.

The mass selector may be configured to selectively transmit or deflect said one or more first mass to charge ratios or first ranges of mass to charge ratios to the aperture at the one or more first times; and to selectively deflect said one or more second mass to charge ratios or second ranges of mass to charge ratios onto the detector at said one or more second times.

The mass selector may be operable such that it transmits or deflects ions to the aperture at said one or more first times, and such that ions do not reach the aperture at said one or more second times. Alternatively, the mass selector may be operable such that it transmits or deflects ions to the detector at said one or more first times, and such that ions do not reach the detector at said one or more second times.

The spectrometer may comprise a translator for moving at least part of the ion source relative to the aperture such that the ion optics focus ions generated at different regions of the ion source through the aperture at different times.

For example, the translator may be configured to move the ion source target plate relative to the area that the laser is incident on and/or relative to the first differential pumping aperture.

This may be used, for example, in a microprobe mode to build up an image of the sample on the target plate.

Although the ion source has been described as comprising a laser and target plate, other types of ion sources may be employed. For example, the ion source may comprise a pusher assembly of a time-of-flight accelerator. The pusher and flight region may form an orthogonal acceleration time of flight instrument. The pusher assembly and ion optics may be arranged and configured to both pulse ions through said aperture and to pulse ions onto the detector upstream of the aperture, e.g. substantially simultaneously or at different times. This may be achieved by providing two adjacent slits or orifices (objects) in the pusher assembly. One slit or orifice may be arranged and configured so that ions are pulsed onto the detector arranged upstream of the aperture, e.g. so as to analyse precursor ions. The other slit or orifice may be arranged and configured so that ions are pulsed through said aperture, e.g. into the second vacuum chamber. These ions may then be fragmented or reacted so as to produce fragment or product ions, and the fragment or product ions may be analysed in a downstream analyser. The precursor ions and their respective fragment or product ions may be associated, e.g. based on their detection times. In these configurations, the pusher electrode may be divided into at least two sections so that one or more section may be activated at any given time so as to pulse ions through either slit or orifice.

The aperture may have a diameter or dimension of ≤y μm, wherein y is selected from the group consisting of: 500; 450; 400; 350; 300; 250; 200; 150; 100; and 50.

The spectrometer may be a time of flight mass spectrometer.

The present invention also provides a method of mass spectrometry or ion mobility spectrometry using the spectrometer described herein.

Accordingly, the present invention also provides a method of mass spectrometry or ion mobility spectrometer comprising:

generating ions with ion source;

separating ions according to their mass to charge ratio in a flight region arranged between said ion source and an aperture; and using ion optics to reflect or deflect ions whilst they separate according to mass to charge ratio in the flight region such that the ions are focussed to a geometrical focal point at said aperture so that the ions are transmitted through the aperture.

The ions may be fragmented or reacted in a fragmentation or reaction device downstream of the aperture, e.g. in a CID fragmentation device, an ETD or ECD fragmentation device, a photo-dissociation device.

The ions, or related fragment or product ions, may be analysed in an analyser downstream of the aperture, e.g. in a mass analyser, an ion mobility separator.

The ions may be transmitted through the aperture and into one or more of the following devices: an ion deceleration device, an ion gate, an ion guide, an ion trap, or an ion detector arranged downstream of said aperture.

The spectrometer may comprise a first vacuum chamber containing the flight region and a second vacuum chamber; wherein the aperture is a differential pumping aperture arranged at the interface between the first and second vacuum chambers. At least one vacuum pump may be used to maintain said first vacuum region at a lower pressure than said second vacuum region.

The ion optics may be arranged and configured so as to cause the ions to arrive at the geometrical focal point at the first differential pumping aperture so that the ions are transmitted through the differential pumping aperture into the second vacuum chamber with high transmission efficiency.

The spectrometer may comprise one or more ion gate upstream and/or downstream of the aperture that selectively transmits ions to and/or from the aperture. The ion transmission properties of the ion gate may be varied with time, e.g. such that ions are blocked at one time and transmitted at another time. The one or more ion gate may select the ions that are transmitted into or through the aperture and/or second vacuum chamber. For example, because the ions separate according to mass to charge ratio in said flight region, the ion transmission property of the ion gate may be varied with time so as to select the mass to charge ratios of the ions that are transmitted through the aperture and/or second vacuum chamber. The ion gate may be a Bradbury-Nielsen ion gate.

A third vacuum chamber may be arranged downstream of the second vacuum chamber, and a second differential pumping aperture may be provided at the interface between the second and third vacuum chambers. Optionally, said third vacuum chamber comprises an ion analyser.

The ions from the second vacuum chamber (e.g. fragment or product ions) may be analysed in the third vacuum chamber.

The analyser in the third vacuum chamber may be a mass analyser such as a time of flight analyser. Accordingly, ions may be pulsed into, or within, the third vacuum chamber onto a detector that determines the mass to charge ratios of these ions from their flight times.

The third vacuum chamber may be maintained at a lower pressure than the second vacuum chamber by a vacuum pump.

The ion source may comprise a sample target plate and/or a laser source. If a target plate is used, the target plate may be arranged in the first vacuum chamber. If a laser source is used, the spectrometer may direct the laser onto the same side of the target plate that the sample is located on, or on the opposite side, in order to ionise the sample.

At least part of the ion source may be arranged in the first vacuum chamber. For example, the sample target plate and/or laser may be arranged in the first vacuum chamber. The laser source may be positioned outside of the first vacuum chamber and may direct laser light through a window in the first vacuum chamber and onto the sample target plate so as to generate ions inside the first vacuum chamber.

The spectrometer may further comprise a lens for focussing a laser from the laser source onto the target plate in one mode of operation; and/or a lens for directing a homogenous laser beam from the laser source onto the target plate in another mode of operation. For example, a focal lens may be used to operate the instrument in a microprobe mode; or a homogenous laser beam may be used to operate the instrument in a microscope mode.

The laser may have a diameter of ≤x μm at the target plate, wherein x is selected from the group consisting of: 250; 200; 150; 100; and 50.

The ion optics may reflect or deflect the ions a plurality of times as they separate according to their mass to charge ratios in the flight region; and/or the ion optics may geometrically focus the ions a plurality of times as they separate according to their mass to charge ratios in the flight region.

The spectrometer may further comprise an ion detector; optionally a position sensitive ion detector.

The detector may be arranged in the first vacuum chamber, optionally adjacent to said aperture. Ions may be directed onto the detector, rather than through the aperture in a mode of operation, e.g. for MS analysis.

The method may determine the mass to charge ratio of an ion from its time of flight through the flight region to the detector, e.g. using the detector in the first vacuum chamber. For example, the duration between a time that a laser pulse generates an ion and a time that the ion is detected may be determined, and then this duration may be used to determine the mass to charge ratio of the ion.

The position at which any given ion strikes the detector may be detected and data that is related to this position may be recorded with the ion signal for the detected ion, thereby indicating the position in the ion source from which the ion originated.

The detector may detect, in one dimension or in two dimensions, the position at which any given ion strikes the detector.

The imaging plane of the ion optics may be located at the detector. For example, the detector may be located in the first vacuum chamber, optionally adjacent to the first differential pumping aperture.

The ion optics may magnify and/or map an image of the ion source to the detector.

The method may therefore operate in a mode wherein the ions are directed onto the detector (i.e. not through the aperture) and another mode wherein the ions are directed through the aperture.

The method may comprise moving at least part of the ion source relative to the aperture such that: in a first mode when said at least part of the ion source is located at a first position, the ion optics focus the ions from the ion source to the aperture; and in a second mode when said at least part of the ion source is located at a second position, the ion optics focus the ions from the ion source to the detector. For example, said at least part of the ion source that is moved may be the target plate and/or laser.

The method may comprise operating a laser switching device such that: in one mode a laser in the laser source is directed at a target plate in the ion source so as to generate ions, and the ion optics focus these ions from the ion source to the aperture; and in another mode a laser in the laser source is directed at the target plate in the ion source so as to generate ions, and the ion optics focus these ions from the ion source to the detector.

The laser in the said one mode may be focussed onto the target plate and the laser in said another mode may project a homogenous beam on the target plate. Alternatively, focussed lasers or homogeneous lasers may be used in both modes.

The method may comprise deflecting or guiding ions using an ion deflector or ion guiding device, wherein the deflector or guiding device is operated in one mode such that the ions are transmitted to the aperture, and is operated in another mode such that the ions are not transmitted to the aperture. In said another mode the ions may be transmitted to a detector, e.g. the detector previously described.

The deflector may be operated such that it does not deflect ions in said one mode and deflects ions in said another mode; or such that it deflects ion trajectories towards and through the aperture in said one mode and does not deflect ions in said another mode; or such that it deflects ions in both modes.

The method may switch the deflector or guiding device between said one mode and said another mode. In said one mode, precursor ions may be directed through said aperture, fragmented or reacted to produce fragment or product ions, and then the resulting fragment or product ions may be mass analysed. In said another mode, precursor ions may be mass analysed at the detector upstream of the aperture. The method may associate precursor ions with their fragment or product ions, e.g. based on their respective detection times.

The method may repeatedly alternate between the two modes, e.g. in order to perform $MS^e$ analysis.

The method may comprise separating ions in the flight region such that ions of different mass to charge ratios arrive at a mass selector at different times. The mass selector may be operated to selectively transmit or deflect one or more first mass to charge ratios or first ranges of mass to charge ratios to the aperture, or a detector, at one or more first times; and to selectively block or deflect one or more second mass to charge ratios or second ranges of mass to charge ratios at one or more second times such that these ions do not reach the aperture, or detector.

A time-varying voltage may be applied to the mass selector in order to achieve these functions.

The detector is desirably the previously described detector, e.g. the detector in the first vacuum chamber, which may be a position sensitive detector.

The mass selector may selectively transmit or deflect said one or more first mass to charge ratios or first ranges of mass to charge ratios to the aperture at the one or more first times; and to selectively deflect said one or more second mass to charge ratios or second ranges of mass to charge ratios onto the detector at said one or more second times.

The mass selector may be operated such that it transmits or deflects ions to the aperture at said one or more first times, and such that ions do not reach the aperture at said one or more second times. Alternatively, the mass selector may be operated such that it transmits or deflects ions to the detector at said one or more first times, and such that ions do not reach the detector at said one or more second times.

The method may comprise moving at least part of the ion source relative to the aperture such that the ion optics focus ions generated at different regions of the ion source through the aperture at different times. For example, the translator may be configured to move the ion source target plate relative to the area that the laser is incident on and/or relative to the first differential pumping aperture. This may be used, for example, in a microprobe mode to build up an image of the sample on the target plate.

Although the ion source has been described as comprising a laser and target plate, other types of ion sources may be employed. For example, the ion source may comprise a pusher assembly of a time-of-flight accelerator. The pusher and flight region may form an orthogonal acceleration time of flight instrument. The pusher assembly and ion optics may be operated to both pulse ions through said aperture and to pulse ions onto the detector upstream of the aperture, e.g. substantially simultaneously or at different times. This may be achieved by providing two adjacent slits or orifices (objects) in the pusher assembly. One slit or orifice may be arranged and configured so that ions are pulsed onto the detector arranged upstream of the aperture, e.g. so as to analyse precursor ions. The other slit or orifice may be arranged and configured so that ions are pulsed through said aperture, e.g. into the second vacuum chamber. These ions may then be fragmented or reacted so as to produce fragment or product ions, and the fragment or product ions may be analysed in a downstream analyser. The precursor ions and their respective fragment or product ions may be associated, e.g. based on their detection times. In these configurations, the pusher electrode may be divided into at least two sections so that one or more section may be activated at any given time so as to pulse ions through either slit or orifice.

The method may be a method of time of flight mass spectrometer.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source.

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions;

(xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) > about 500 V peak to peak.

The AC or RF voltage may have a frequency selected from the group consisting of: (i) < about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) > about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) < about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) > about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

The present invention may provide a multi-turn or multi-reflecting TOF mass spectrometer in a first vacuum region arranged to geometrically focus a portion of ions through a small differential pumping aperture. The pumping aperture and ion focus may be small enough to maintain the pressure in the first vacuum region low enough for high resolution or high molecular weight analysis, unperturbed by collisions with residual gas. A second region may be disposed downstream of said aperture, containing one or more analytical devices operating at a higher relative pressure than said first vacuum region.

By using the stigmatic focusing characteristic inherent to multi-turn TOF system, it is feasible to send the ions at the image plane of the TOF system through a small aperture to a second stage of analysis that is at higher pressure, such as CID or IMS. A further TOF analysis region may be provided downstream.

The present invention may also provide a first TOF mass spectrometer with an ion selector that operates based on the positional origin of ions from the ion source. The positional origin can be selected by directing a laser beam onto a target, e.g. MALDI target. The TOF optics subsequently direct the ions of interest through an aperture at the stigmatic focus into a second device or mass spectrometer.

By moving the spatial position of the object (ion source), the ions at the image (detector plane) will move correspondingly. This can be used to select ions based on their origin, and the selected ions can be made to enter the aperture described above.

BRIEF DESCRIPTION OF THE DRAWINGS

Various embodiments will now be described, by way of example only, and with reference to the accompanying drawing in which.

DETAILED DESCRIPTION

Figure 1A:
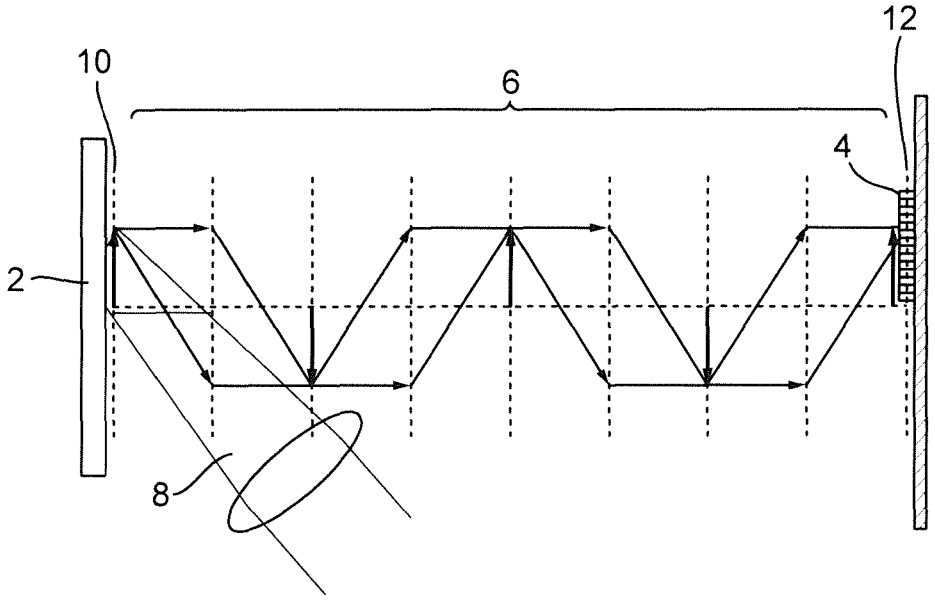
FIGS. 1A and 1B show schematics of a known instrument operated in a microscope and microprobe mode respectively.
Figure 1B:
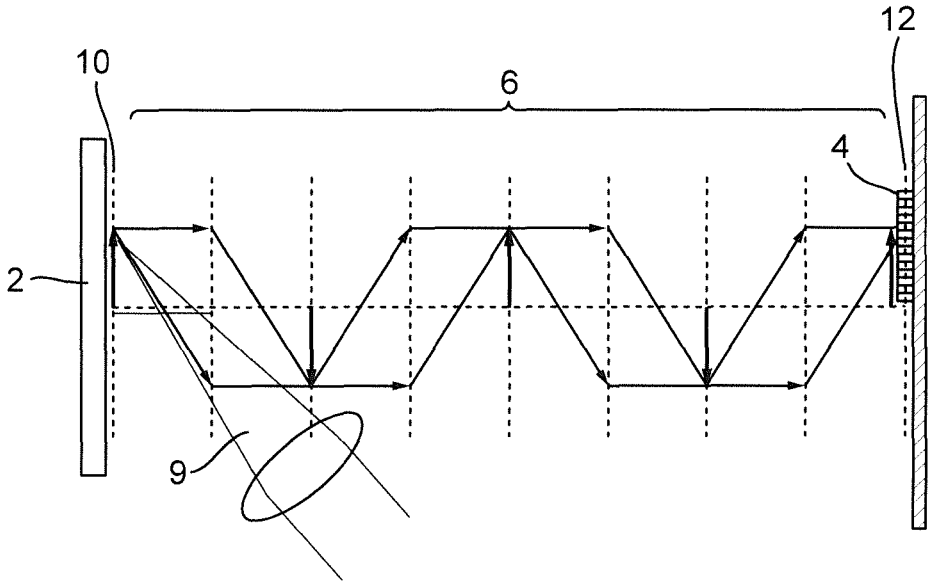

FIGS. 1A and 1B show schematics of a known instrument. The instrument comprises a sample target plate 2, a two-dimensional detector 4, and triple-focussing ion optics 6 arranged between the target plate 2 and ion detector 4. A first mode of operation, known as a microscope mode, is shown in FIG. 1A, wherein a relatively wide diameter (e.g. a few hundred micron), homogenous laser beam 8 is directed at the target plate 2, thereby producing ions at the illuminated area over an ion object plane 10. The ion optics 6 guide the ions from the object plane 10 to an imaging plane 12 located at the detector 4. The ion optics 6 comprise three electrostatic sectors that cause the ions to be reflected multiple times with multiple stigmatic focal points prior to the ions striking the detector 4. The ion optics 6 magnify and map the image from the target plate 2 to the detector 4.

The ion optics 6 provide a time of flight region between the target plate 2 and the detector 4 that allows ions to separate according to their mass to charge ratios prior to striking the detector 4. The instrument can therefore be used as a time of flight mass analyser. In particular, the mass to charge ratio of an ion detected at any point on the detector 4 can be determined from the time between the ion being generated (i.e. from the timing of the laser pulse that generated the ion) and the time that the ion is detected at the detector 4. The ion optics map ions from different regions on the target plate 2 to respective different regions on the two-dimensional detector 4. As such, the location on the target plate 2 from which the ion came is determined by the detector 4. The mass to charge ratios of the ions generated from the sample at the target plate 2 can therefore be mapped.

FIG. 1B shows a second mode of operation, known as a microprobe mode. This mode is substantially the same as that described in relation to FIG. 1A, except that rather than illuminating a relatively wide area on the target plate 2 with the laser, the laser 9 is focussed to relatively small spot on the target plate 2. Ions are generated by the laser 9 and are mapped to the detector 4 in the same way as described in relation to FIG. 1A. The laser beam 9 is then focussed on a different region of the target plate 2 so as to map ions from that different region to a different region of the detector 4. This can be repeated so as to build up a mass to charge ratio map of the ions generated at the target plate 2.

Figure 2:
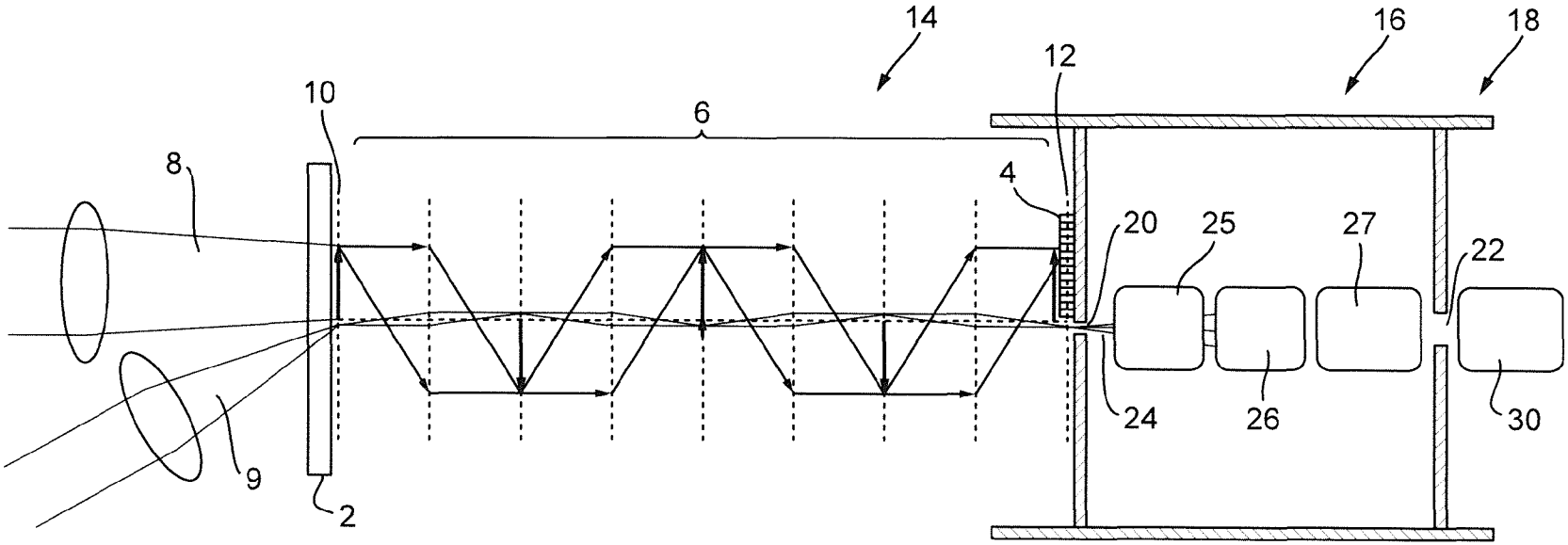
FIG. 2 shows a schematic of an instrument according to an embodiment of the present invention, wherein ions may be detected at a detector in a first vacuum chamber or may be directed through a differential pumping aperture to a downstream vacuum chamber.

FIG. 2 show a schematic of an instrument according to an embodiment of the present invention. The instrument comprises laser sources 8,9, a first vacuum chamber 14, a second vacuum chamber 16 and a third vacuum chamber 18. The first and second vacuum chambers 14,16 are interconnected by a first differential pumping aperture 20, and the second and third vacuum chambers 16,18 are interconnected by a second differential pumping aperture 22.

The first vacuum chamber 14 is a relatively low pressure vacuum chamber and may comprise a MALDI ion source target plate 2 arranged at the opposite end of the vacuum chamber 14 to the first differential pumping aperture 20, and a position sensitive detector 4 arranged adjacent to the first differential pumping aperture 20. Other types of target plate 2 may alternatively be used. Ion optics 6 are arranged between the target plate 2 and the first differential pumping aperture 20 for causing ions generated at the target plate 2 to be reflected or deflected as the ions travel from the target plate 2 towards the first differential pumping aperture 20.

The second vacuum chamber 16 is at a relatively higher pressure than the first vacuum chamber 14, or contains regions or gas cells maintained at a higher pressure than the first vacuum chamber 14. For example, the second vacuum chamber 16 may comprise one or more of: an ion deceleration region 24; and/or an ion mobility separator (IMS) region or gas cell; and/or a collisionally induced dissociation (CID) region or gas cell; and/or an electron transfer dissociation (ETD) region or cell; and/or an electron capture dissociation (ECD) region or cell; and/or an photo-dissociation region or gas cell. For example, the second vacuum chamber 16 may comprise an ion deceleration region 24, a fragmentation or reaction cell 25 for producing fragment or product ions (such as a CID cell, ETD cell, ECD cell, photo-dissociation cell, or ion reaction cell), an IMS cell 26, a second fragmentation or reaction cell 27 for producing second generation fragment or product ions (such as a CID cell, ETD cell, ECD cell, photo-dissociation cell, or ion reaction cell). The first cell may be a different type of cell to the second cell, e.g. to cause different types of fragmentation.

The third vacuum chamber 18 may comprise a time of flight mass analyser 30.

The instrument of FIG. 2 may be operated in a number of modes of operation. The instrument may be operated in the same mode as described in relation to FIG. 1A, wherein a relatively wide diameter laser beam 8 illuminates the target plate 2 and the resulting ions are mapped to the detector 4 (i.e. a microscope mode). The ion optics 6 and detector 4 may therefore be the same as those in FIG. 1A. In FIG. 2, the laser beam 8 is shown as illuminating the target plate 2 in the transmission mode in order to ionise the sample, i.e. the laser 8 illuminates the opposite side of the target plate 2 to that which the sample is located on. However, the laser 8 may illuminate the sample in a reflection mode, i.e. from the side of the target plate 2 that the sample is located on. The mass to charge ratios of the ions generated at different regions of the sample may therefore be mapped to the detector 4 in the same way as described in relation to FIG. 1A. For example, the time of flight region 6 may be a 100K FWHM TOF region. This mode is particularly useful for the mass analysis of unfragmented or unreacted parent ions in an MS mode.

Figure 3:
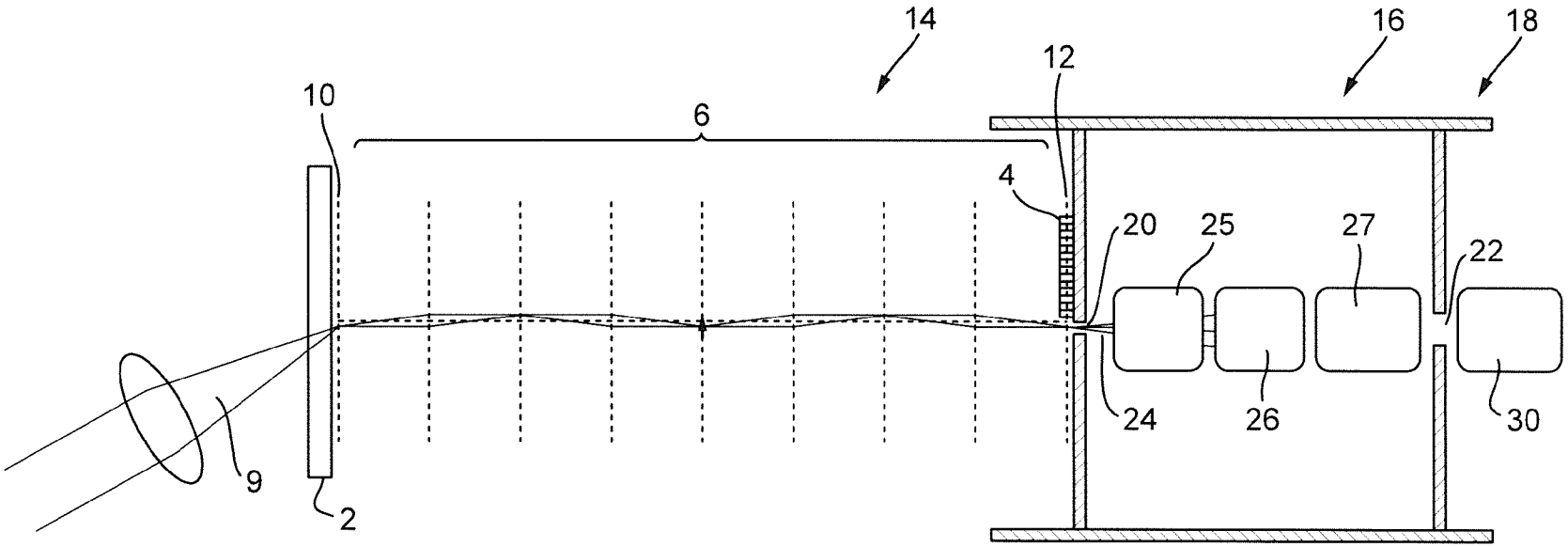
FIG. 3 shows a schematic of the instrument illustrated in FIG. 2, when operated in a mode in which ions are directed through the differential pumping aperture to the downstream vacuum chamber.

FIG. 3 shows a schematic of the instrument in FIG. 2 when operated in a second mode. In this mode, the laser 9 is focussed onto the target plate 2 in order to generate the ions, i.e. a microprobe mode. However, in contrast to the microprobe mode shown in FIG. 1B, in the mode shown in FIG. 3 the ions are not focussed onto the detector 4 by the ion optics 6. The ion optics 6 are arranged and configured so as to cause the ions to be reflected multiple times with multiple stigmatic focal points, but the ions are caused to be focussed onto the first differential pumping aperture 20, rather than at the detector 4. This may be achieved by positioning the focal point of the laser 9 on the target plate 2, relative to the first differential pumping aperture 20, such that the ion optics 6 focus the ions at the first differential pumping aperture 20 rather than the detector 4. The ions are thus focussed at and transmitted through the first differential pumping aperture 20 with high efficiency. The nature of the multi-reflecting ion optics 6 provides a tightly focused ion image in a stigmatic focussing time of flight image plane 12, i.e. at the first differential pumping aperture 20. This tightly focussed image typically has a diameter of, for example, approximately ≤100 μm. This enables the first differential pumping aperture 20 to be of a relatively small area, e.g. ≤200 μm, without significantly blocking ions from entering the first differential pumping aperture 20. As the ion optics 6 enable the first differential pumping aperture 20 to be made relatively small, it is relatively easy to maintain the gas pressure in the first vacuum chamber 14 relatively low. This avoids significant collisions between the ions and gas molecules during the flight paths of the ions through the first vacuum chamber 14. The ions pass through the first differential pumping aperture 20 into the second vacuum chamber 16, wherein the ions are subjected to manipulation or processing at a higher pressure than in the first vacuum chamber 14. For example, the ions may be fragmented in the second vacuum chamber 16 by collisionally induced dissociation with a gas at a higher pressure than the first vacuum chamber 14, so as to generate fragment ions. Alternatively, or additionally, ions may be interact or react with one or more of: reagent ions, charged particles such as electrons, molecules, or photons in the second vacuum chamber 16 at a higher pressure than the first vacuum chamber 14, so as to generate fragment or product ions. For example, the ions may be subjected to ETD and/or ECD reactions, and/or may be fragmented by photons such as photons from an ultra-violet light source. The ions may be subjected to ion mobility separation at a pressure higher than the pressure in the first vacuum chamber 14 prior to and/or subsequent to the ions being fragmented or reacted. Alternatively, the ions may be subjected to such ion mobility separation without being fragmented or reacted.

The ions may be decelerated in a deceleration region 24 of the second vacuum chamber 16 prior to (or instead of) being fragmented, reacted, or ion mobility separated.

The higher pressure in the second vacuum chamber 16 is able to be maintained without significantly adversely affecting (i.e. undesirably increasing) the pressure in the first vacuum chamber 14 as the first differential pumping aperture 20 is relatively small.

In the illustrated embodiment, the ions received in the second vacuum chamber 16 from the first vacuum chamber 14 are subjected to CID or ETD fragmentation in cell 25. The resulting first generation fragment ion and/or product ions are then separated in an ion mobility separator 26. The ions that elute from the ion mobility separator 26 may, or may not, then be fragmented, such as by CID or ultra-violet photo-dissociation in cell 27, so as to generate second generation fragment ions. The first or second generation fragment ions are then transmitted through the second differential pumping aperture 22 into the third vacuum chamber 18. The third vacuum chamber 18 may comprise a mass analyser, such as a time of flight mass analyser 30, for mass analysing the ions received therein. The third vacuum chamber 18 may be maintained at a lower pressure than the second vacuum chamber 16 to enable the analysis of the ions.

The target plate 2 may be moved relative to the laser focal point and the first differential pumping aperture 20 such that ions are generated at different regions of the sample plate 2 at different times, and such that the ion optics 6 direct these ions from different regions through the first differential aperture 20 at different times.

Alternatively, or additionally, the instrument may be used to select ions for analysis based on their position on the target plate 2. This may be achieved by selectively arranging the spatial location of the ion origin relative to the first differential pumping aperture 20 so that ions are stigmatically focussed through the system by the ion optics 6 and are directed through the first differential pumping aperture 20 into a downstream device, such as an ion analyser. For example, in a MALDI system, an area of interest on the target plate 2 may be identified. This may be achieved by examining the sample on the target plate 2, e.g. using an optical microscope, and selecting one or more region of the sample desired to be to analysed. For example, it may be desired to analyse a particular cell, or cells, at a particular location on the target plate 2. The target plate 2 may then be moved so that the sample region(s) of interest is illuminated by the laser, such that the ions generated therefrom are focussed at the first differential pumping aperture 20. The ion mapping properties of the ion optics 6 may therefore be used to transmit the ions from the sample region of interest through the first differential pumping aperture 20 and to the downstream device. Less desirably, a relatively wide laser beam may illuminate the target plate 2, causing regions of the target plate 2 that do not contain sample of interest to be illuminated by the laser. However, these regions of the target plate may not be located at the correct position relative to the first differential pumping aperture 20 for the ion optics to focus ions from these regions through the first differential pumping aperture.

Figure 4:
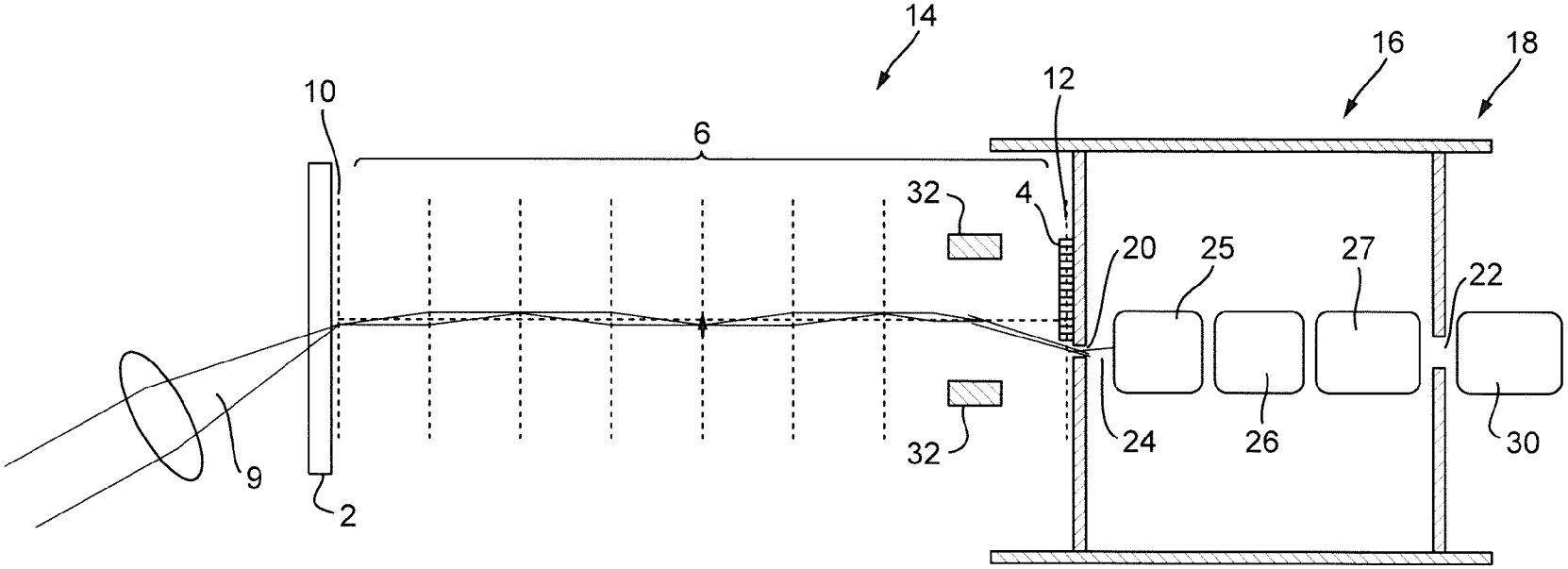
FIG. 4 shows a schematic of the instrument illustrated in FIG. 2, when operated in a mode in which ions are deflected through the differential pumping aperture to the downstream vacuum chamber.

FIG. 4 shows a schematic of the instrument in FIG. 2 when operated in another mode. This mode of operation is substantially the same as that described in relation to FIG. 3, except that the laser focal spot on the target plate 2 is positioned relative to the first differential pumping aperture 20 such that the ion optics 6 guide the ions from the target plate 2 to the detector 4, rather than to the first differential pumping aperture 20. The ions may therefore strike the detector 4 and be analysed in a manner corresponding to that described in relation to FIG. 1B. A deflector lens 32 is arranged in an ion deflector region and, when activated, this deflector lens 32 deflects ions to the first differential pumping aperture 20. The stigmatic focal properties of the ion optics 6 cause the deflected ions to be focussed at the first differential pumping aperture 20 and so, as described in relation to the other embodiments, the first differential pumping aperture 20 is able to be made relatively small whilst maintaining a high ion transmission efficiency into the second vacuum chamber 16.

As the ions travel through the time of flight region in the first vacuum chamber 14 they separate according to their mass to charge ratios. It may be desired to selectively transmit only ions of one or more individual mass to charge ratio, or a selected range of mass to charge ratios. This may be achieved by activating the deflector lens 32 so that as the desired mass to charge ratio(s) arrive at the deflector lens 32, the ions are deflected to and through the first differential pumping aperture 20. When ions of mass to charge that are of less interest (e.g. are not desired to be fragmented) reach the ion deflector 32, the deflector 32 may be inactivated or operated such that these ions do not reach the first differential pumping aperture 20. A time varying voltage may be applied to the deflector 32 to achieve this. The deflector 32 may be configured to cause ions to be deflected only slightly, e.g. by a few hundred microns.

It is also contemplated that the embodiment shown in FIG. 3 may use an ion deflector 32 to deflect ions onto the detector 4. As the ions travel through the time of flight region in the first vacuum chamber 14 they separate according to their mass to charge ratios. It may be desired to selectively transmit only ions of one or more individual mass to charge ratio, or a selected range of mass to charge ratios to the detector 4. This may be achieved by activating a deflector lens 32 so that as the desired mass to charge ratio(s) arrive at the deflector lens 32, the ions are deflected onto the detector 4. When ions of mass to charge that are not to be deflected reach the ion deflector 32, the deflector 32 may be inactivated or operated such that these ions do not reach the detector 4 and may be transmitted to the first differential pumping aperture 20. A time varying voltage may be applied to the deflector 32 to achieve this. The deflector 32 may be configured to cause ions to be deflected only slightly, e.g. by a few hundred microns. Alternatively to an ion deflector 32, an ion gate may be arranged at, or upstream of, the first differential pumping aperture 20. The ion gate may be selectively opened and closed as a function of time so that as the desired mass to charge ratio(s) arrive at the ion gate, the ion gate is opened such that these ions are transmitted to and through the first differential pumping aperture 20. When ions of mass to charge that are of less interest reach the ion gate, the gate may be closed such that these ions do not reach the first differential pumping aperture 20. A time varying voltage may be applied to the ion gate to achieve this.

Although embodiments have been described in terms of focussing ions through the first differential pumping aperture 20, it is contemplated that the same technique may be used to focus ions through other types of apertures, such as an ion acceptance aperture of an ion analyser, ion detector, ion guide, ion trap, or other downstream device.

Furthermore, although embodiments have been described wherein ions are focussed by the ion optics 6 through a single aperture, it is contemplated that multiple apertures may be provided and that ions from different regions on the target plate 2 may be focussed at respective different apertures by the ion optics 6. A single laser beam may illuminate the different regions, or multiple laser beams may be used to illuminate the different regions. The same type, or different types, of downstream device may be provided downstream of the different apertures.

Although the present invention has been described with reference to preferred embodiments, it will be understood by those skilled in the art that various changes in form and detail may be made without departing from the scope of the invention as set forth in the accompanying claims.

For example, although laser ion sources such as MALDI ion sources have been described in the above embodiments, other ion sources may be used. Laser ion sources are useful as they may be used to generate a relatively small spatial object at the target plate 2. However, other types of ions sources may be used that do not comprise a laser and/or target plate 2. For example, an ESI ion source may replace the target plate. Ion sources that provide a relatively low gas load on the first vacuum chamber 14 are desirable. For example, ion sources that operate at pressures that are significantly lower than atmospheric pressure may be used.

The spectrometer may be operated in a microscope mode, wherein a relatively wide homogenous laser beam is directed at the target plate; or in a microprobe mode, wherein a laser beam is focussed onto the target plate. High resolution MS data can be acquired, both in a microscope mode or in a conventional microprobe mode. For example, the source can be operated in an MS only mode where the image is directed from a wider laser area (microscope mode) onto a pixelated TOF detector 4. The laser may illuminate the target plate 2 from the sample side or the opposite side in the microscope or microprobe modes. However, in a microscope mode it may be useful to illuminate the target plate 2 in a reflection mode rather than a transmission mode, i.e. to illuminate the target plate from the same side that the sample is located on.

In the microprobe modes, the ions signals can either be recorded on the pixelated detector 4, or on another type of detector such as a point detector that may be arranged either before or downstream of the first differential pumping aperture.

The laser spot size and image size in the microprobe modes may be around 10 μm, which is ideal for histological analysis.

The invention claimed is:

1. A mass spectrometer or ion mobility spectrometer comprising:

an ion source;

an aperture;

a flight region arranged between said ion source and aperture for separating ions according to their mass to charge ratio;

a first vacuum chamber containing the flight region; and a second vacuum chamber;

wherein the aperture is a differential pumping aperture arranged at an interface between the first and second vacuum chambers; the spectrometer further comprising:

ion optics arranged and configured for causing ions to be reflected or deflected a plurality of times whilst they separate according to mass to charge ratio in the flight region and such that the ions are focussed to a geometrical focal point at said aperture so that the ions are transmitted through the aperture.

2. The spectrometer of claim 1, wherein the ion optics are arranged and configured to cause the mean ion path to be reflected or deflected as the ions pass along the flight region; and to cause the ion trajectories to alternate between diverging and converging as the ions pass along the flight region such that the ions converge to the geometrical focal point at said aperture.

3. The spectrometer of claim 1, wherein the ion optics comprise a plurality of electric sectors.

4. The spectrometer of claim 1, wherein the ion source is arranged at the object plane of the ion optics and/or the aperture is arranged at the imaging plane of the ion optics.

5. The spectrometer of claim 1, comprising an ion detector arranged in the first vacuum chamber, optionally adjacent to said aperture.

6. The spectrometer of claim 1, comprising an ion detector and a translator for moving at least part of the ion source relative to the aperture such that:

in a first mode when said at least part of the ion source is located at a first position, the ion optics focus the ions from the ion source to the aperture; and in a second mode when said at least part of the ion source is located at a second position, the ion optics focus the ions from the ion source to the detector.

7. The spectrometer of claim 1, comprising a detector and a laser switching device operable such that:

in one mode a laser in the laser source is directed at a target plate in the ion source so as to generate ions, and the ion optics focus these ions from the ion source to the aperture; and in another mode a laser in the laser source is directed at the target plate in the ion source so as to generate ions, and the ion optics focus these ions from the ion source to the detector.

8. The spectrometer of claim 1, comprising an ion deflector for deflecting the ions, wherein the deflector is operable in one mode such that the ions are transmitted to the aperture, and is operable in another mode such that the ions are not transmitted to the aperture.

9. The spectrometer of claim 8, wherein the spectrometer is configured such that in said another mode the ions are transmitted to a detector.

10. The spectrometer of claim 1, comprising a mass selector; wherein, in use, ions separate in the flight region such that ions of different mass to charge ratios arrive at the mass selector at different times; and wherein the mass selector is configured to selectively transmit or deflect one or more first mass to charge ratios or first ranges of mass to charge ratios to the aperture, or a detector, at one or more first times;

and to selectively block or deflect one or more second mass to charge ratios or second ranges of mass to charge ratios at one or more second times such that these ions do not reach the aperture, or detector.

11. The spectrometer of claim 1, comprising a translator for moving at least part of the ion source relative to the aperture such that the ion optics focus ions generated at different regions of the ion source through the aperture at different times.

12. The spectrometer of claim 1, wherein the aperture has a diameter or dimension of ≤y μm, wherein y is selected from the group consisting of: 500; 450; 400; 350; 300; 250; 200; 150; 100; and 50.

13. The spectrometer of claim 1, wherein the spectrometer is a time of flight mass spectrometer and/or the flight region is a time of flight region.

14. A method of mass spectrometry or ion mobility spectrometry comprising:

generating ions with ion source;

separating ions according to their mass to charge ratio in a flight region arranged between said ion source and an aperture; and using ion optics to reflect or deflect ions a plurality of times whilst they separate according to mass to charge ratio in the flight region such that the ions are focussed to a geometrical focal point at said aperture so that the ions are transmitted through the aperture;

wherein the aperture is a differential pumping aperture arranged at an interface between a first vacuum chamber containing the flight region and a second vacuum chamber.

15. The spectrometer of claim 1, wherein ions separate temporally according to their mass to charge ratio in the flight region.

16. The method of claim 14, comprising separating the ions temporally according to their mass to charge ratio in the flight region.

17. A mass spectrometer or ion mobility spectrometer comprising:

an ion source;

an aperture;

a flight region arranged between said ion source and aperture for separating ions according to their mass to charge ratio;

a first vacuum chamber containing the flight region; and a second vacuum chamber;

wherein the aperture is a differential pumping aperture arranged at an interface between the first and second vacuum chambers; the spectrometer further comprising:

ion optics arranged and configured for causing the mean ion path of ions to be reflected or deflected whilst the ions separate according to mass to charge ratio in the flight region and such that the ions are focussed to a geometrical focal point at said aperture so that the ions are transmitted through the aperture.

18. The spectrometer of claim 17, wherein ions separate temporally according to their mass to charge ratio in the flight region.

* * * * *